US005855366A

United States Patent [19]

Chang

[11] Patent Number: 5,855,366

[45] Date of Patent: Jan. 5, 1999

[54] WORK SUPPORTING DEVICE MOUNTABLE ON A WORKTABLE OF A CIRCULAR SAWING APPARATUS

[75] Inventor: Chiu-Tsun Chang, Taichung, Taiwan

[73] Assignee: P & F Brother Industrial Corporation, Taichung, Taiwan

[21] Appl. No.: 960,221

[22] Filed: Oct. 29, 1997

[51] Int. Cl.[6] ..... B27B 27/03

[52] U.S. Cl. ..... 269/315; 83/468.3; 83/471.3; 83/581

[58] Field of Search ..... 83/468.2, 468.3, 83/468.7, 467.1, 471.3, 468.5, 581; 269/303, 304, 315

[56] References Cited

U.S. PATENT DOCUMENTS

| | | | |
|---|---|---|---|
| 4,934,233 | 6/1990 | Brundage et al. | 83/397 |
| 5,042,348 | 8/1991 | Brundage et al. | 83/471.3 |
| 5,181,448 | 1/1993 | Terpstra | 83/468.3 |
| 5,297,463 | 3/1994 | O'Banion et al. | 83/468.3 |

*Primary Examiner*—Eugenia A. Jones
*Assistant Examiner*—T. Anthony Vaughn
*Attorney, Agent, or Firm*—Finnegan, Henderson, Farabow, Garrett & Dunner, L.L.P.

[57] ABSTRACT

A work supporting device includes an elongated body, an extension plate and a locking unit. The elongated body has elongated first and second sections and an intermediate curved section. A gap is formed between the first and second sections. The curved section is indented from the work supporting faces at the gap. The first section has a first end distal from the second section and a second end proximate to the second section. The extension plate is connected pivotally to the first section of the elongated body. The extension plate is pivotable about an axis transverse to the first section between a first position where the extension plate extends into the gap in order to shield at least a part of the gap, and a second position where the extension plate extends beyond the first end of the first section of the elongated body in order to prolong the length of the first section from the first end of the first section. The locking unit is provided for releaseably locking the extension plate in one of the first and second positions.

3 Claims, 3 Drawing Sheets

WORK SUPPORTING DEVICE MOUNTABLE ON A WORKTABLE OF A CIRCULAR SAWING APPARATUS

BACKGROUND OF THE INVENTION

1. Field of the Invention

This invention relates to a work supporting device, more particularly to a work supporting device that is mountable on a worktable of a circular sawing apparatus for use with a movable support to hold and support a workpiece therebetween.

2. Description of the Related Art

Referring to FIG. 1, a conventional circular sawing apparatus is shown to comprise a worktable 10, a saw-holding arm 11, a circular saw 12 mounted on the saw-holding arm 11, a work supporting device 13 and a movable support or turntable 14 which cooperates with the work supporting device 13 in order to hold and support a workpiece (not shown) therebetween. The work supporting device 13 has elongated first and second sections 131, 132 and an intermediate curved section 133. The first and second sections 131, 132 have work engaging faces 1311, 1321 aligned with one another in a lengthwise direction thereof. A gap 134 is formed between the first and second sections 131, 132. The curved section 133 is indented from the clamping faces 1311, 1321 at the gap 134. The first section 131 has a downward inclined end 1312 near the gap 134 to prevent the circular saw 12 from interfering with the first section 131 when the circular saw 12 is operated at an angle with respect to the worktable 10.

When the circular sawing apparatus is utilized to cut a workpiece of a length that is smaller than the width of the gap 134, it is difficult to hold the workpiece between the movable support 14 and the work supporting device 13. In addition, since the contact length of the work supporting device 13 is fixed, when a workpiece that is longer than the work supporting device 13 is held between the movable support 14 and the work supporting device 13, the workpiece cannot be held securely on the worktable 10 due to insufficient contact surface area of the workpiece with the work supporting device 13.

SUMMARY OF THE INVENTION

It is therefore a main object of the present invention to provide a work supporting device which has an adjustable length in order to more securely hold a workpiece of a shorter or longer dimension in cooperation with a movable support.

According to the present invention, the work supporting device is mountable on a worktable of a circular sawing apparatus for use with a movable support to hold and support a workpiece therebetween. The work supporting device comprises:

an elongated body having elongated first and second sections and an intermediate curved section interconnecting the first and second sections, the first and second sections having work engaging faces aligned with one another in a lengthwise direction thereof and having a gap formed therebetween, the curved section being indented from the work engaging faces at the gap, the first section having a first end distal from the second section and a second end proximate to the second section;

an extension place connected pivotally to the first section of the elongated body, the extension plate being pivotable about an axis transverse to the first section and parallel to the work engaging face of the first section to move between a first position where the extension plate extends into the gap in order to shield at least a part of the gap, and a second position where the extension plate extends beyond the first end of the first section of the elongated body in order to prolong the length of the first section from the first end of the first section; and means for releaseably locking the extension plate in one of the first and second positions.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 1:
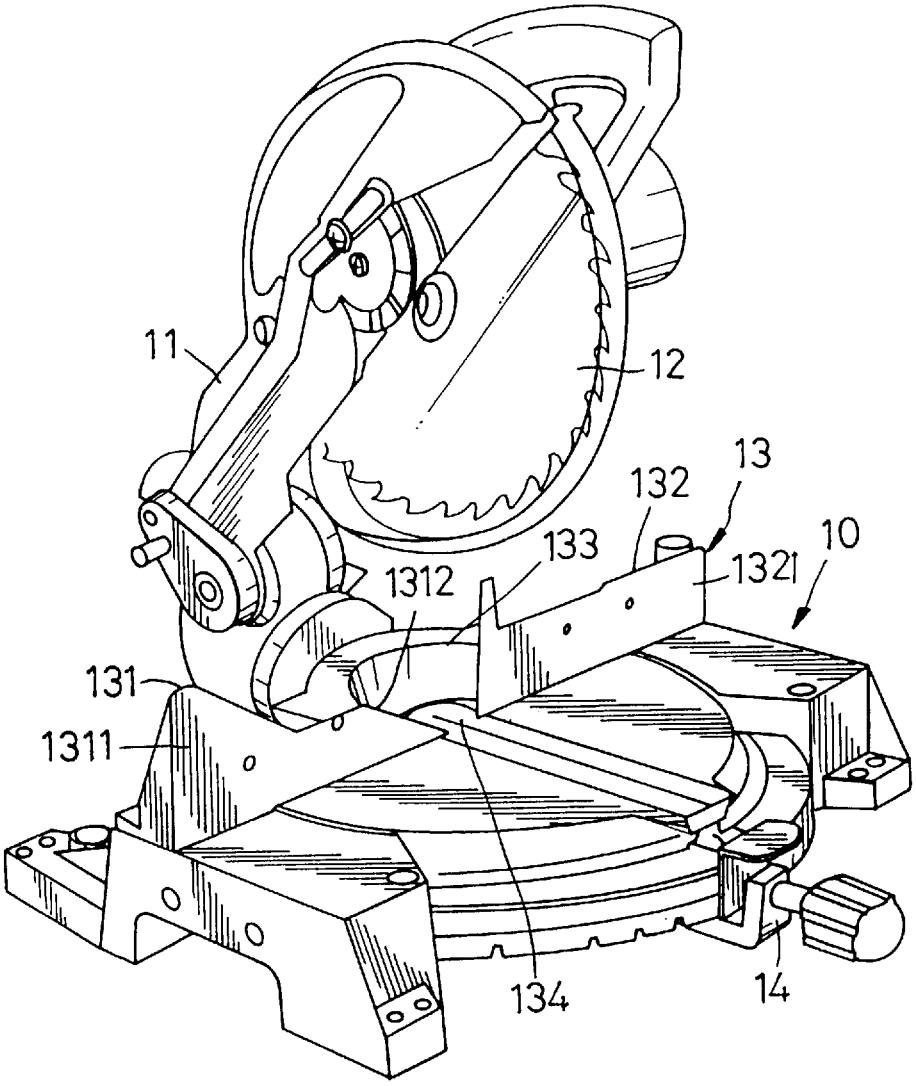
FIG.1 PRIOR ART
FIG. 1 is a perspective view of a conventional circular sawing apparatus.
Figure 2:
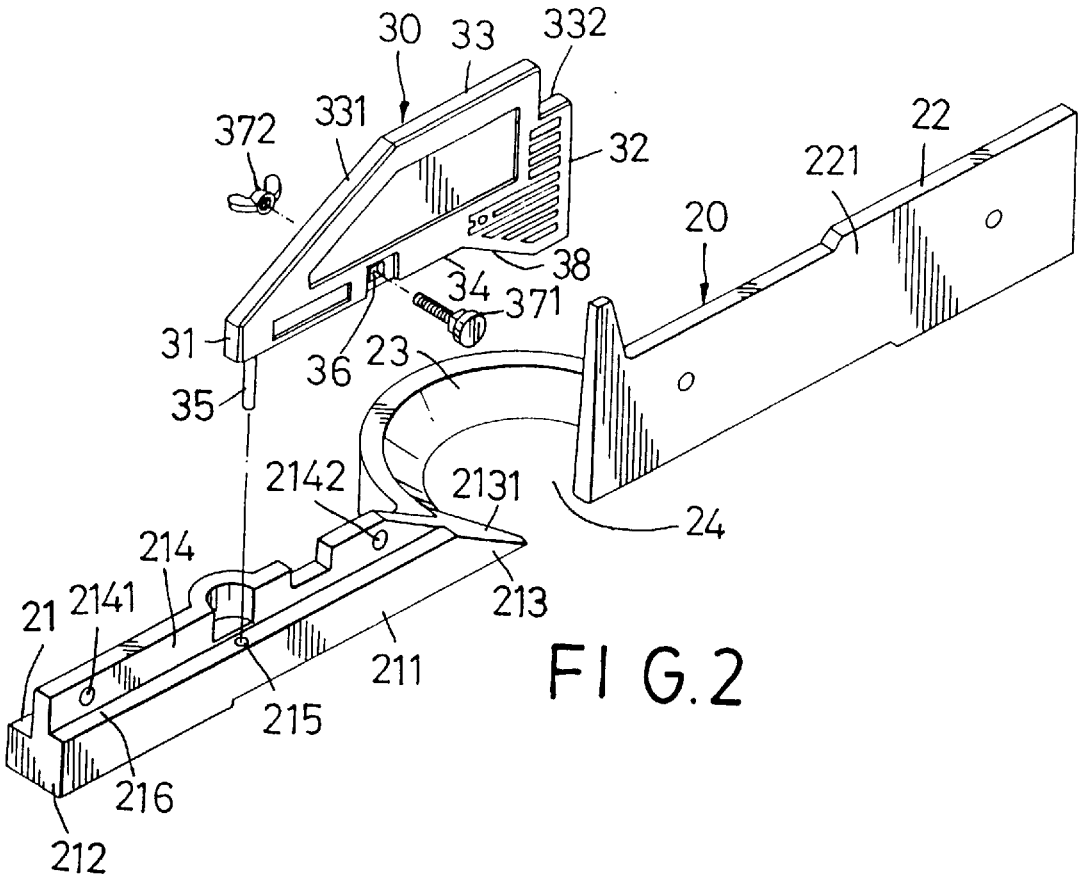
FIG. 2 is an exploded view of a preferred embodiment of a work supporting device according to the present invention.
Figure 3:
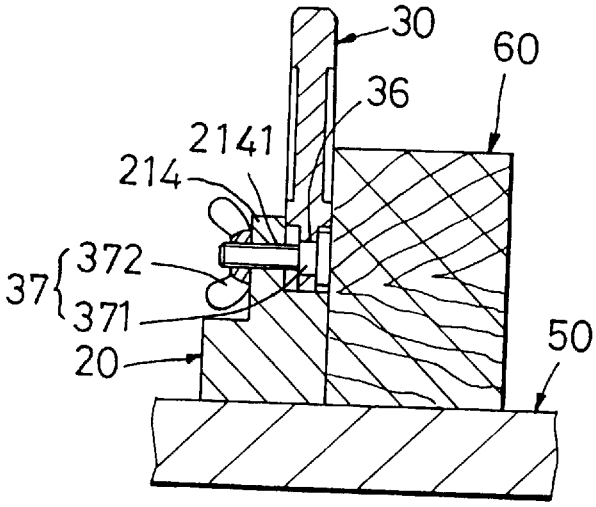
FIG. 3 is a cross sectional view of a preferred embodiment of the work supporting device according to the present invention.

Referring to FIGS. 2 and 3, a preferred embodiment of a work supporting device according to the present invention is shown to comprise an elongated body 20 and an extension plate 30. The work supporting device is mounted on a worktable 50 and is employed to hold a workpiece 60 in cooperation with a movable support (not shown).

The elongated body 20 has elongated first and second sections 21, 22 and an intermediate curved section 23 interconnecting the first and second sections 21, 22. The first and second sections 21, 22 have work engaging faces 211, 221 aligned with one another in a lengthwise direction thereof and have a gap 24 formed therebetween. The curved section 23 is indented from the work engaging faces 211, 221 at the gap 24 as is done in the prior art. The first section 21 has a first end 212 distal from the second section 22 and a second end 213 proximate to the second section 22. The first section 21 has a projection 214 formed on a top edge 216 thereof along the length of the same and a pivot hole 215 formed in the top edge 216. The projection 214 has two positioning holes 2141, 2142 formed transversely therethrough and near the first and second ends 212, 213. The second end 213 of the first section 21 has an inclined face 2131.

Figure 4:
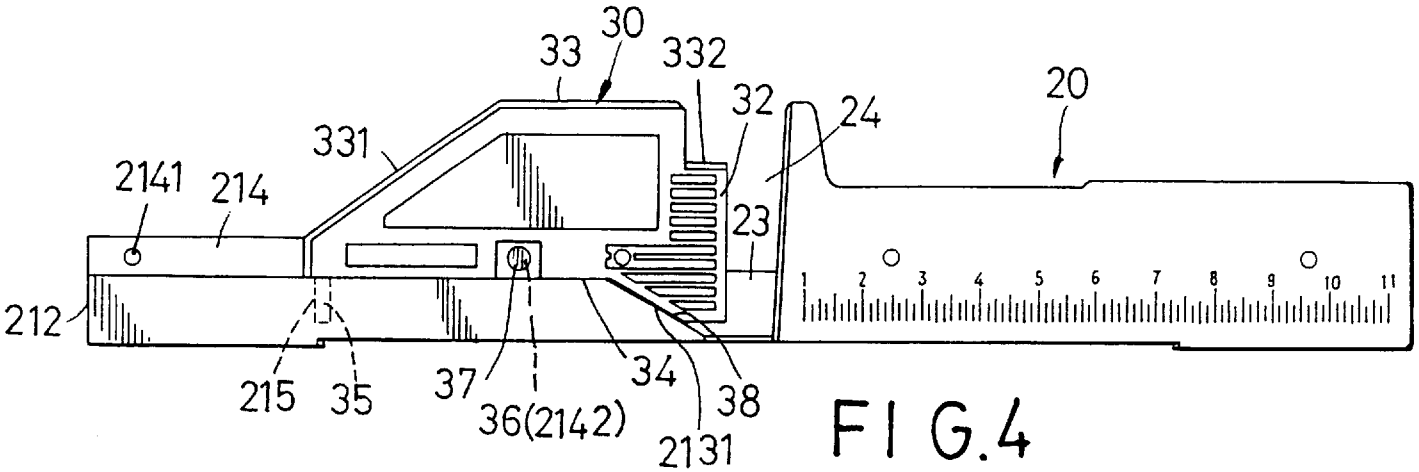
FIG. 4 is a planar schematic view illustrating an extension plate of the work supporting device according to the present invention in a first position.
Figure 5:
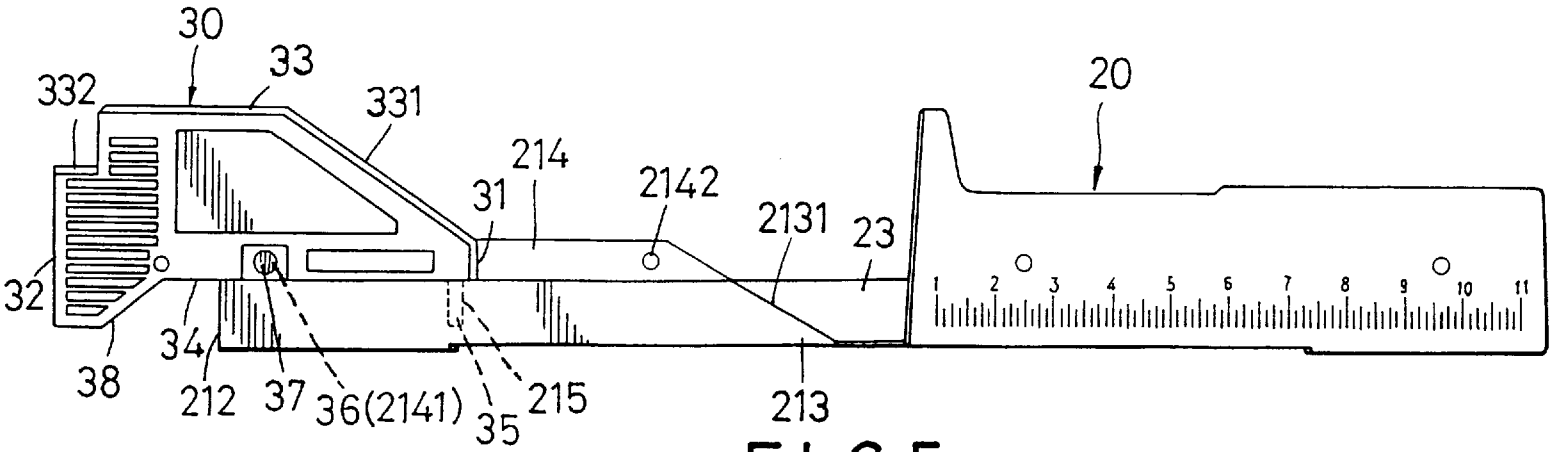
FIG. 5 is a planar schematic view illustrating the extension plate of the work supporting device in a second position.

The extension plate 30 has opposite first and second side edges 31, 32 and upper and lower edges 33, 34 interconnecting the first and second side edges 31, 32. The lower edge 34 has a pivot pin 35 extending downward near the first side edge 31 into the pivot hole 215 so that the extension plate 30 is connected pivotally to the top edge 216 of the first section 21 about the pivot pin 215. The extension plate 30 is pivotable between a first position where the second side edge 32 of the extension plate 30 extends into the gap 24 in order to shield at least a part of the gap 24, as best illustrated in FIG. 4, and a second position where the second side edge 32 of the extension plate 30 extends beyond the first end 212 of the first section 21 of the elongated body 20 in order to prolong the length of the first section 21 from the first end 212 of the first section 21, as best illustrated in FIG. 5.

Locking means 37 are provided for releaseably locking the extension plate 30 in the first and second positions. The locking means 37 includes a carriage bolt 371 and a wing nut 372. The carriage bolt 371 extends through a rectangular hole 36 formed in the extension plate 30 near the lower edge 34. The carriage bolt 371 may extend through one of the positioning holes 2141, 2142 and engage the wing nut 372 in order to fasten the extension plate 30 to either one of the first and second positions. Therefore, the work supporting device can be utilized to securely hold a workpiece 60 of a shorter or longer dimension by rotating the extension plate 30 about the pivot pin 35 to the first position or the second position.

The lower edge 34 of the extension plate 30 has a downward inclined portion 38 near the second side edge 32. The downward inclined portion 38 engages complementarily the inclined face 2131 of the first section 21 of the elongated body 20. The upper edge 33 of the extension plate 30 has a downward inclined portion 331 near the first side edge 31, and a notch 332 formed near the second side edge 32 of the extension plate 30. The downward inclined portion 331 and the notch 332 prevent a circular sawing apparatus (not shown) on the worktable 50 from interfering with the extension plate 30 when in use.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

I claim:

1. A work supporting device mountable on a worktable of a circular sawing apparatus for use with a movable support to hold and support a workpiece therebetween, said work supporting device comprising:

an elongated body having elongated first and second sections and an intermediate curved section interconnecting said first and second sections, said first and second sections having work engaging faces aligned with one another in a lengthwise direction thereof and having a gap formed therebetween, said curved section being indented from said work engaging faces at said gap, said first section having a first end distal from said second section and a second end proximate to said second section;

an extension plate connected pivotally to said first section of said elongated body, said extension plate being pivotable about an axis transverse to said first section and parallel to said work engaging face of said first section to move between a first position where said extension plate extends into said gap in order to shield at least a part of said gap, and a second position where said extension plate extends beyond said first end of said first section of said elongated body in order to prolong the length of said first section from said first end of said first section; and means for releaseably locking said extension plate in one of said first and second positions.

2. The work supporting device as claimed in claim 1, wherein said extension plate has opposite first and second side edges, and upper and lower edges interconnecting said first and second side edges thereof, said lower edge having a downward inclined portion near said second side edge, and said second end of said first section of said elongated body having an inclined face which engages complementarily with said downward inclined portion of said lower edge when said extension plate is in said first position.

3. The work supporting device as claimed in claim 2, wherein said upper edge of said extension plate has a downward inclined portion near said first side edge thereof, and a notch formed at said second side edge of said extension plate.

* * * * *